United States Patent [19]

Conde

[11] Patent Number: 4,535,974

[45] Date of Patent: Aug. 20, 1985

[54] IMPACT ABSORBING PARKING SPACE BARRIER

[76] Inventor: Henry Conde, 359 English Oak Ct., Waldorf, Md. 20601

[21] Appl. No.: 599,140

[22] Filed: Apr. 12, 1984

[51] Int. Cl.[3] ..... E04H 17/00

[52] U.S. Cl. ..... 256/1; 404/10

[58] Field of Search ..... 256/1, 13.1; 404/10, 404/6

[56] References Cited

U.S. PATENT DOCUMENTS

| | | | |
|---|---|---|---|
| 3,416,484 | 12/1968 | Chapman . | |
| 3,591,144 | 7/1971 | Iving . | |
| 3,602,109 | 8/1971 | Harrington . | |
| 3,963,218 | 6/1976 | Glaesener | 256/1 X |
| 4,240,766 | 12/1980 | Smith | 256/1 X |
| 4,269,534 | 5/1981 | Ryan | 256/1 X |
| 4,341,488 | 7/1982 | Ryan | 404/10 |
| 4,373,464 | 2/1983 | Blau | 404/10 |

FOREIGN PATENT DOCUMENTS

| | | | |
|---|---|---|---|
| 1967075 | 3/1977 | Fed. Rep. of Germany | 404/10 |

*Primary Examiner*—Andrew V. Kundrat

*Attorney, Agent, or Firm*—Dowell & Dowell

[57] ABSTRACT

A barrier or guard rail which is designed to be installed between vehicle parking spaces or stalls in a parking lot and which includes an elongated cushioned impact absorbing surface which is supported in an elevated relationship to the surface of the parking lot to protect vehicle side panels and doors from being damaged by the accidental impact of an adjacent vehicle or vehicle door.

12 Claims, 4 Drawing Figures

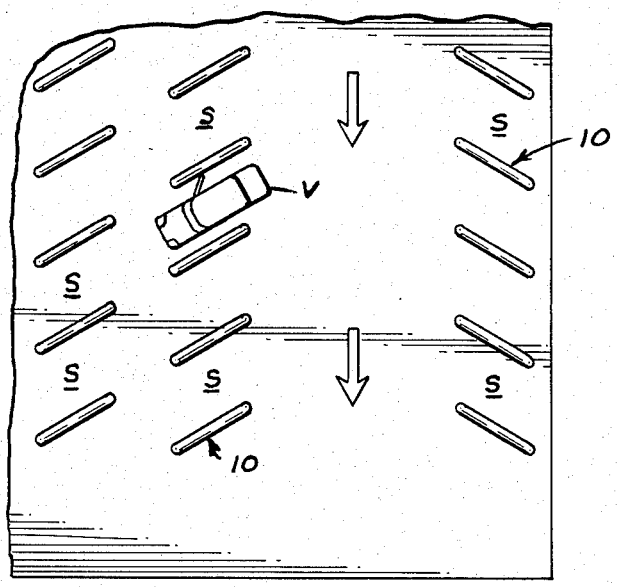
Fig. 1
Fig. 2
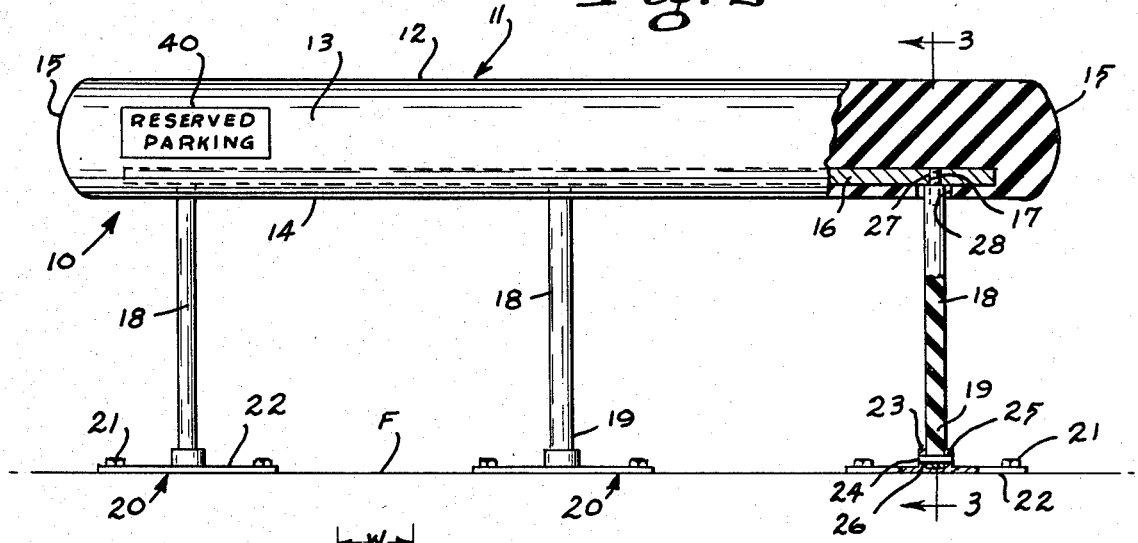
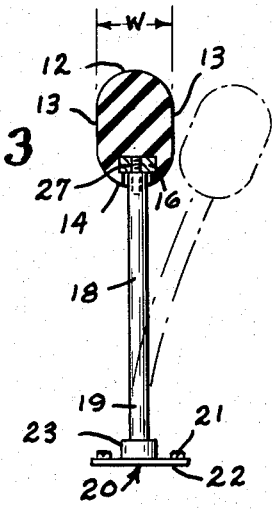
Fig. 3
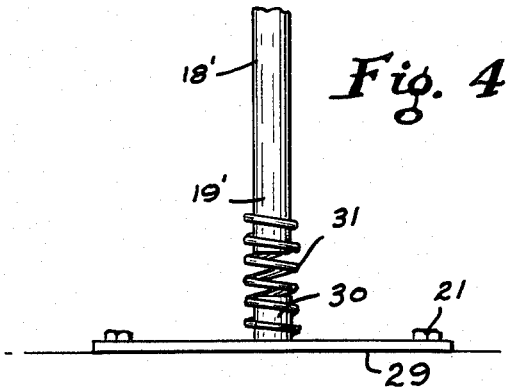
Fig. 4

IMPACT ABSORBING PARKING SPACE BARRIER

BACKGROUND OF THE INVENTION

1. Field of the Invention

This invention is generally directed to traffic or vehicle barriers for use in parking lots and particularly to a barrier having an elongated impact absorbing surface which extends between adjacent vehicle parking spaces at an elevated relationship with respect to the surface of the parking lot to thereby both define the limits of the parking space and to provide a cushioned barrier to protect the side panels and doors of a parked vehicle from damage which may otherwise be caused by the operation or use of the vehicle in an adjacent parking space.

2. History of the Prior Art

Anyone who has ever owned and operated a motor vehicle is aware of the hazards inherently associated with parking in a parking lot where the parking spaces are oriented in generally parallel relationship with one another. All too often operators of vehicles do not observe or heed the lines which define the parking spaces and park their vehicles in such a position within a parking space that the width of the immediately adjacent parking space is diminished requiring that anyone using the adjacent space must take extra care in maneuvering their vehicle into and out of the parking space. On many occasions, such incorrect parking habits make it impossible for the operators of mid-size or larger vehicles to utilize a parking space which would otherwise be available.

There are also the operators of various vehicles who protect their vehicles from any accidental damage by deliberately occupying two or more parking spaces by parking their vehicle perpendicularly with respect to the defined parking area. Under such circumstances, it is impossible for other vehicle operators to utilize the additional parking spaces. Another annoying feature for people using parking lots is returning to a vehicle to find that someone else has parked so close to the side of the vehicle that it is impossible to gain access.

The inconveniences caused by inconsiderate drivers parking incorrectly in a parking lot may be a secondary problem, however, when compared to the amount of vehicle body damage which results to cars parked in parking lots. All to often someone pulling into a parking space may turn too narrowly or broadly causing the bumper of their vehicle to engage the side of an adjacent vehicle. In other circumstances, people carelessly swing a vehicle door open causing it to impact against an adjacent vehicle. A further problem is created by drivers who do not follow the designated traffic lanes but negligently cut across parking areas thereby increasing the possibility of an accident in the parking lot.

Many of the foregoing problems are further complicated in urban areas where parking lot space is extremely expensive and limited. In such areas, municipalities have permitted what is known as "compact car" spacing in public parking lots. All too often the operator of a large vehicle will park in a space designated as parking for "compact cars" only with the result that there is little or no room to permit entry and exit from the vehicle without causing the doors of the vehicle to impact the body of an adjacent vehicle.

Due to the repair expenses which result from body damage caused by parking lot accidents, many vehicle owners take preventive measures to protect their vehicles. As an option, some people will place a protective strip along the side body of an automobile as an impact barrier. Such side molding on vehicles, however, is not an effective deterrent to body damage due to the different configurations and variations in sizes of automotive vehicles. Other vehicle owners will simply park their vehicles in a remote section of the parking lot where very few people would normally park. This practice is inconvenient to the motor vehicle operator and in areas where remote parking is not possible the vehicle operator is left having to risk damage by parking within the normal parking area.

To date, there has been little development toward meeting the problems discussed above with respect to use of public parking areas. In U.S. Pat. No. 4,341,488 to Ryan a guide post device is disclosed for use in directing a vehicle into proper alignment within a parking space. In Ryan, a single verticle guide post is selectively mounted either to the floor of the parking area or suspended from the ceiling so as to be engageable by the vehicle. Once the guide post has been engaged a light or other signal indicates to the vehicle operator that the vehicle is at its proper position within the parking area.

Another U.S. Pat. No. 3,416,484 to Chapman discloses cushion members which may be selectively mounted to the structural columns which are frequently encountered in parking garages. These cushion members are meant to prevent automotive vehicles from impacting directly against the columns.

In view of the foregoing, it would appear that there is a recognized need to provide barriers for parallel parking spaces to not only protect parked vehicles but to insure proper spacing within the parking lot and to increase safety within a parking area by insuring that vehicles must use the authorized traffic lanes and not criss-cross from one space to another within the lot.

SUMMARY OF THE INVENTION

A parking space delineation barrier which is disposed between vehicle parking spaces in a parking lot and which includes an elongated impact absorbing rail member which is supported in an elevated position with respect to the floor of the parking lot by one or more vertically extending standard members which are selectively received within mounting plates secured to the floor of the garage. In some embodiments of the invention, the vertical standard members may be resiliently mounted or formed of a resilient material so that the entire barrier member will yield under impact of a moving object.

It is a primary object of this invention to provide an elongated barrier or bumper member between adjacent vehicles in a vehicle parking lot wherein an elongated rail portion of the barrier is formed of a cushioned material so that if engaged by a vehicle door or fender that there will be no resultant damage to the door or fender.

It is yet another object of the present invention to provide an elongated barrier member which may be selectively mounted to define the limits of vehicle parking spaces in a parking lot and which is mounted at a vertical height which permits the barrier member to be easily viewable by the operator of a motor vehicle and which will insure that the door of an adjacent vehicle cannot be moved beyond the barrier when being opened.

It is another object of the present invention to provide an elongated barrier member which may be selectively installed to define the parallel sides of a vehicle parking space which will also discourage or prohibit vehicle traffic from criss-crossing through a parking area thereby directing traffic through the proper driving lanes.

It is yet another object of the present invention to provide an impact absorbing barrier which may be selectively positioned to define the parallel sides of vehicle parking spaces in a parking lot wherein the barrier is supported on flexible standards so that the barrier member is yieldable under impact.

It is still another object of the present invention to provide a vehicle barrier having an elongated cushioned guard rail which extends generally parallel with and substantially along the length of a parking space to thereby both define the limits of the parking space and to provide an impact barrier to prevent one vehicle from damaging an adjacent vehicle and in which the barrier member may be removably mounted for repair or replacement.

BRIEF DESCRIPTION OF THE DRAWINGS

FIG. 1 is an illustrational view of a parking lot showing the impact absorbing parking barriers of the present invention aligned to define the parallel parking spaces in a parking lot and showing a motor vehicle parked between two of the impact absorbing barriers.

FIG. 2 is a side elevational view of the impact absorbing barrer of the present invention having portions broken away to show a cross-section.

FIG. 3 is a cross-sectional view taken along lines 3—3 of FIG. 2 showing the resilient characteristics of the embodiment in broken lines.

FIG. 4 is a partial view of a vertical standard member of another embodiment of the invention.

DESCRIPTION OF THE PREFERRED EMBODIMENT

With continued reference to the drawings, the impact absorbing parking barriers 10 of the present invention are shown in FIG. 1 as they are arranged in parallel relationship to define the sides of adjacent parking spaces. The parking spaces are generally designated at S. Each parking space is of a size to permit parking of an automotive vehicle V therein.

The impact absorbing parking barrier 10 is shown in FIG. 2 as including an elongated barrier rail member 11 having an upper surface 12, side walls 13, lower walls 14 and ends 15. The barrier rail is preferably formed of an elastomeric material which is molded or otherwise placed around a centrally disposed support plate 16. The barrier rail may be formed of any other material so long as at least the side walls 13 are padded or otherwise coated so that such side walls are a buffer or bumper which will not scratch or damage objects which impact thereagainst. The support plate 16 may be formed of a rectangular strip of metal or a hard impact plastic. A plurality of screw threaded openings 17 are formed in spaced relationship along the length of the plate 16.

The rail member 11 is supported in elevated relationship with respect to the surface or floor of the parking lot F by means of a number of generally equally spaced vertical posts or standards 18 which are selectively mounted adjacent their lower most ends 19 within mounting plates 20. The mounting plates 20 are bolted at 21 or otherwise secured to the parking surface F so as to be securely retained in place.

The mounting plates may consist of a generally rectangular base plate 22 having a generally centrally disposed and upward opening circular socket member 23 which selectively receives the ends 19 of the vertically oriented standard members 18. The vertical standard members are secured within the socket portions 23 of the mounting plates 20 by a pin or bolt member 24 which extends through aligned openings 25 and 26 through the socket member and lower portion of the standard members respectively.

The upper ends of the vertically standard members includes a threaded portion 27 which is selectively received within the threaded openings 17 in the plate 16. In order to permit the upper threaded end portion of the vertical standard members to be engageable with the plate member 16, a series of recessed openings 28 are provided along the lower surface 14 of the rail member 11 in an area adjacent each of the threaded openings 17 in the plate member.

As shown in FIGS. 2 and 3, the vertical standard members 18 are constructed in a rod like configuration and are preferably formed of a flexible material such as a rubber or plastic so that such vertical members will yield upon impact as shown in dotted lines in FIG. 3. The vertical standard members could alternatively be formed in a cylindrical configuration of the same material. In addition, although three vertical standard members are shown in FIG. 2 to support the rail member 11, it is envisioned that a single standard member having a somewhat varied configuration could be used to adequately support the rail member 11.

With specific reference to FIG. 4, a modified mounting configuration is disclosed. In the modified mounting configuration of FIG. 4, the mounting plate 29 includes a generally centrally disposed cylindrical stud 30 over which a spring means 31 is securely attached. In this embodiment of the invention, the vertical posts or standards 18' may be formed of a solid or hollow metal or plastic material with the lower end 19' thereof being securely received within the upper portion of the spring 31. The spring 31 will permit the vertical standard member 18' to move relative to the fixed base plate when either the rail member 11 or the column member 18' is impacted by an object.

The impact absorbing barriers of the present invention should include a rail member 11 which is of sufficient length to prevent adjacent automotive vehicles from being damaged by the operation of the door of an adjacent vehicle. In this regard, the rail member 11 is preferably four to eight feet in length. Due to the need to conserve space within a parking lot, the width W of the rail member 11 should preferably not be greater than the width of a standard painted stripe currently used to define the width of a parking space or approximately two to four inches.

In addition to the foregoing, the rail portion of the impact absorbing parking barrier should be positioned at an elevation which will both make it easily viewable by an operator of a motor vehicle as well as to provide an adequate barrier to prevent accidental damage by an adjacent vehicle. Generally, the vertical posts or standards 18 should be approximately two and one half to three feet in height. The height of the rail member may also vary it being recognzied that the size of the rail member should be sufficient to absorb the impact of a door or other portion of an automotive vehicle which is impacted against the rail member.

As was previously discussed, the placement of the barrier members of the present invention in a parking lot will effectively prohibit traffic from criss-crossing through the parking lot in other than the designated travel lanes as shown by the arrows in FIG. 1. In order to further increase the utility of the impact parking barriers of the present invention the rail members 11 may selectively carry indicia 40 designating a reserved or specific parking space for purposes of identifying the space as being reserved or to be helpful in relocating a parked vehicle in the parking lot. As opposed to carrying indicia showing a specific space, advertising may be suitably carried or printed on the parking rails 11 or such rails may be integrally formed of a colored material with different colors defining different areas of the parking lot.

Because the impact absorbing barriers of the present invention are subject to being engaged by automotive vehicles, they should preferably be constructed so that the component parts may be readily replaced. In this regard, various forms of mounting plates and connections between the support post or standards 18 and the rail members 11 may be made without deviating from the scope of the present invention.

I claim:

1. A vehicle body protection barrier for use in a parking lot having a surface which is divided into a plurality of generally parallel parking spaces in which vehicles are parked in a generally parallel relationship comprising, an elongated rail means mounted in elevated relationship to the parking lot surface and between two adjacent parking spaces and extending along a portion of the length and generally parallel to the vehicle parked within such spaces, said rail means having oppositely oriented elongated side walls which are in generally facing relationship with the parking spaces, at least said sidewalls of said rail means having an outer impact absorbing surface, vertically extending post means having first and second ends, base means secured to the parking lot surface between the adjacent spaces, said first end of said post means being connected to said base means and said second end of said post means being connected to said rail means.

2. The vehicle body protection barrier of claim 1 in which said base means includes a plate member, means for securing said plate member to the parking lot surface, socket means carried by said plate means and extending upwardly therefrom, said second end of said post means being mounted within said socket means, and means for securing said second end of said post means within said socket means.

3. The parking barrier apparatus of claim 2 in which said post means is releaseably secured within said socket means.

4. The vehicle body protection barrier of claim 1 including at least two horizontally spaced post means, each of said post means being removably secured to said rail means.

5. The vehicle body protection barrier of claim 4 in which said post means are resilient so as to be yieldable upon impact.

6. The vehicle body protection barrier of claim 5 in which said post means and said base means are integrally formed.

7. The vehicle protection barrier of claim 5 in which said rail means is generally between four to eight feet in length.

8. The vehicle body protection barrier of claim 7 in which the width of said rail means as measured between said oppositely oriented sidewalls is generally between approximately two to four inches.

9. The vehicle body protection barrier of claim 4 in which said post means are removably connected to said base means.

10. The vehicle body protection barrier of claim 1 including at least two horizontally spaced post means, and said rail means being generally four to eight feet in length.

11. The vehicle body protection barrier of claim 10 in which said post means are resilient so as to be yieldably upon impact.

12. A barrier apparatus for use in parking lots having surfaces defined by generally parallel parking spaces comprising an elongated generally horizontally extending rail means having inner and outer portions, first and second ends and oppositely disposed elongated sidewall portions, said inner portion of said rail means being defined by an elongated core means and said outer protion being a generally resilient material which is carried by said core so that said sidewall portions have an outer surface formed of an impact absorbing material, at least two generally vertically extending horizontally spaced post means having first and second end portions, a base means engageable with the surface of the parking lot, said first end portion of said post means being connected to said base means, and said second ends of said post means being removably secured to said core means of said rail means whereby said elongated rail means may be selectively disposed in general parallel relationship between two adjacent parking spaces in an elevated position with respect to the parking lot surface.

* * * * *